US005575824A

United States Patent [19]

Brown et al.

[11] Patent Number: 5,575,824

[45] **Date of Patent: *Nov. 19, 1996**

[54] COAL PREPARATION DEVICE

[76] Inventors: Charles K. Brown, 8317 Robert Bruce Dr.; David K. Brown, 11232 Midlothian Tnpk, #141, both of Richmond, Va. 23235

[ * ] Notice: The term of this patent shall not extend beyond the expiration date of Pat. No. 5,275,631.

[21] Appl. No.: 368,497

[22] Filed: Jan. 3, 1995

[51] Int. Cl.[6] ..... C10L 5/00

[52] U.S. Cl. ..... 44/505; 44/621; 44/622; 44/627; 44/629

[58] Field of Search ..... 44/505, 621, 622, 44/627, 629

[56] References Cited

U.S. PATENT DOCUMENTS

| | | | |
|---|---|---|---|
| 4,482,351 | 11/1984 | Kitazawa et al. | 44/621 |
| 4,574,045 | 3/1986 | Crossmore, Jr. | 44/627 |
| 5,275,631 | 1/1994 | Brown et al. | 44/505 |

*Primary Examiner*—Jerry D. Johnson
*Attorney, Agent, or Firm*—Walter G. Finch; Nancy A. Smith

[57] ABSTRACT

The present invention provides for a fuel coal processing system having a centrifugal type coal pulverizer and an electrostatic type coal purifier and an optional fuel coal size classifier all combined into one integral, cooperatively acting fuel coal preparation device in one embodiment, and a centrifugal type coal pulverizer and fuel coal size classifier combined in a second embodiment. The centrifugal type coal pulverizer may be a counter rotating cup and ring assembly for breaking apart the coal particles and impurities. The coal particles and impurities leave the pulverizer in flat, radiating, sheet pattern which passes through the electrostatic purifier or separator. The electrostatic separator has a pair of plates which are oppositely charged and arranged next to the pulverizer. The top plate is negatively charged to attract the positively charged pure coal particles and repel the negatively charged pyritic particles. The bottom plate is positively charged to attract the negatively charged pyritic particles and repel the positively charged pure coal particles. A scoop ring then deflects downward the pyritic particles for refuse removal. The pure coal particles are deflected upwards to the burner.

16 Claims, 4 Drawing Sheets

COAL PREPARATION DEVICE

FIELD OF THE INVENTION

The invention relates generally to methods and apparatuses for processing coal for burning, with less environmental contamination, in steam generation boilers such as are used in electric power generation facilities, and more particularly to a coal pulverizer-purifier-classifier used in conjunction therewith.

PRIOR ART AND BACKGROUND OF THE INVENTION

More specifically, the purpose of this invention is to improve the technology of pulverizing coal for burning in electric power generation boilers. This is done with a machine that is basically a system of spinning counter rotating rotors uniquely combined either with means for electrostatically and/or aerodynamically separating the fine pure coal from the pyritic and other impurities, with both separation and classification means, or with classification means only.

In U.S. Pat. No. 5,275,631, issued to Charles K. Brown and David K. Brown on Jan. 4, 1994, for a multicup dual counter rotating rotor centrifugal pulverizer, combined with purification means and classifier means, the object is to produce coal for burning with a lower sulfur content, thereby reducing the sulfuric acid emissions into the atmosphere, as is now being mandated by the government.

As chunks of coal are fed in through an axial center mounted feed tube, they are caused to smash repeatedly, at high velocity, onto other coal chunks and particles which have accumulated on the rings. By having the coal particles themselves act as the primary abrasion and reduction agents, material wear is minimized. Reduced in size from the series of abrasive collisions, the particles finally exit as an evenly dispersed circumferential spray of very fine material. At this point in the process, an in-stream aerodynamic and/or electrostatic separation action can readily be utilized to remove a high percentage of the sulfur and iron pyritic impurities contained therein.

Currently used pulverizing technology uses direct crushing means such as hammer mills, ball mills or roll mills of various configurations. In these mills, air is swept through the mill and as the coal is reduced to a fine enough size to be airborne the dust particles are entrained in the air stream and carried out of the mill to the combustor.

For material to leave the mill it has to stay in the mill until it is reduced to dust fine enough to become airborne by repeated crushing actions of the rolling or flailing elements of the mill. Pure coal and impure coal both leave the mill when ground fine enough to be swept up by the air currents blowing through the mill. Therefore, only limited separation of pure and impure coal takes place in these types of reduction mills.

When coal is mined, it often carries impurities mixed in its seams in the form of streaks ranging from small fractions of an inch to several inches in thickness. These stratified streaks of impurities are chiefly composed of both iron pyrites and sulfur, and when intermixed with the coal, comprise what is known as "bone" coal. Sulfur can also appear as chunks called "sulfur balls". Advanced coal cleaning methods remove a significant portion of this material, but a great deal of it remains with the coal. The bone coal is approximately three and one third times more dense and considerably harder than pure coal. Being harder, the bone coal requires greater energy to be reduced to dust in conventional mills. Yet, the mechanical crushing elements found in these types of mills do eventually reduce the bone coal to a fine enough size to be carried out to boiler burners by the air sweeping elements.

Thus, this conventional system of reduction offers a major drawback since the reduction of bone coal in these mills is not only useless, but the additional crushing power required to reduce the bone coal as well as the metal on metal contact produced therein results in high amounts of wear on mechanical parts. The present invention seeks, as one of its purposes, to use a means of reduction that will break down all or most of the coal passing through it to the extent that pyrites, ash-producing minerals and toxic elements (such as mercury and arsenic) can be separated from relatively pure coal by electrostatic means. The electrostatic means is effective only on particles 1/400 of an inch in size or smaller (–250 mesh).

It has been found that if the coal could be ground to a finer consistency (micronized) it would burn at a lower temperature and less Nitrogen Oxide (NOx) would be formed. Many available coals are low enough in sulfur content that the purification stages described above and embodied in U.S. Pat. No. 5,275,631 would not be required but if the end product leaving the pulverizer was fine enough the NOx problem would be helped. Therefore, another embodiment of the invention using a pulverizer to reduce the coal to a fine enough consistency combined with a size classifier to reject any remaining oversized chunks of coal coming out of the pulverizer would be effective in processing such low-sulfur coal. The oversized coal would be returned to the pulverizer for regrinding and the end results are greatly improved in the form of a higher percentage of finely ground coal product.

The construction and operation of apparatus and system will be described for pulverizing the coal. Also, two means will be shown for separating out the impurities. A further size classifying means will be discussed that will separate combustible size coal dust and oversize chunks that are returned to the mill for further reduction.

The use of this unique system of fuel preparation makes it possible to reduce operating costs of flue gas desulfurizers or where flue gas desulfurizers cannot be installed to markedly reduce sulfur dioxide emissions. The same mineral impurities in coal which contain iron and copper sulfites (pyrites) also contain combinations of ash-producing minerals and toxic elements which can be separated from the coal along with the pyrites. Further, the system can be used without separation means for pulverizing coal that has a low sulfur content.

OBJECTS OF THE INVENTION

It is an object of this invention to improve the technology associated with pulverizing coal for burning in electric power and industrial steam generation systems.

Another object of this invention is to provide a novel coal pulverizer purifier classifier.

To provide a novel coal pulverizer purifier classifier which effectively pulverizes the coal fine enough for electrostatic purification is still another object of this invention.

Yet another object of this invention is to provide a coal pulverizer purifier classifier which may incorporate a triboelectrostatic charge differentiator to reject impure pyritic particles and subsequently produce a cleaner final coal product.

To provide a novel coal pulverizer purifier classifier which uses a size classifier to return oversize coal chunks to the mill for further reduction is another object of this invention.

And to provide a novel coal pulverizer purifier classifier which is economical to manufacture and both efficient and reliable in operational use is still another object of this invention.

And still yet another object of this invention is to provide a novel combination of centrifugal coal pulverizer and classifier means which reduce atmospheric pollution by fueling steam generating boilers with a finer grade of coal that burns efficiently at a lower temperature thereby reducing the production of Nitrogen Oxide (NOx) gases, the source of the Nitric Acid component of Acid Rain and a major component of smog.

Another object of this invention is to provide a novel coal pulverizer which is economical to manufacture, efficient and reliable in operation and easy to maintain.

BRIEF DESCRIPTION OF THE DRAWINGS

These and other attendant advantages and objects of this invention will be obvious and apparent from the following detailed specification and accompanying drawings in which.

DESCRIPTION OF THE PREFERRED EMBODIMENTS

Figure 1:
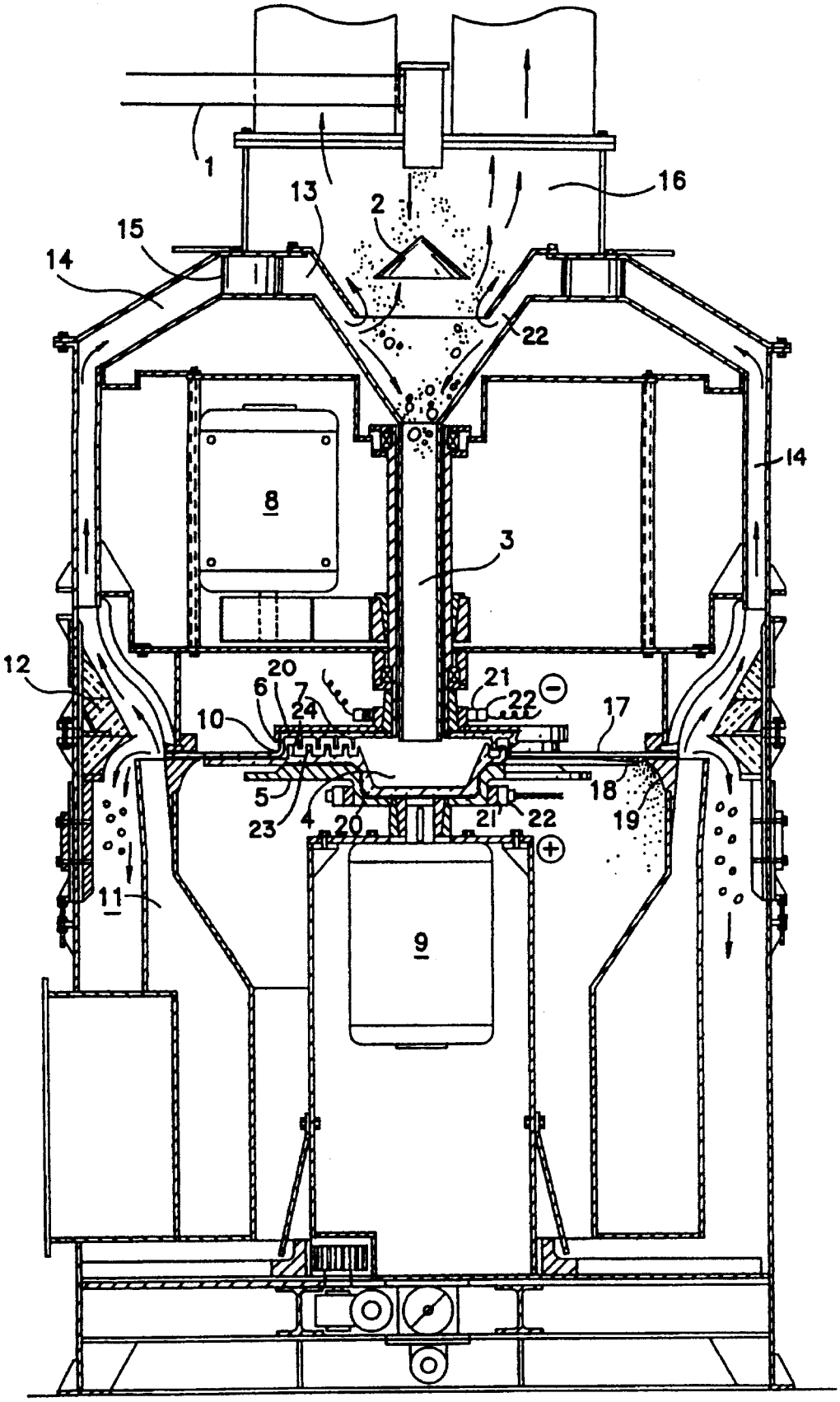
FIG. 1 is a sectional elevation through a combined aerodynamic and electrostatic model.
Figure 2:
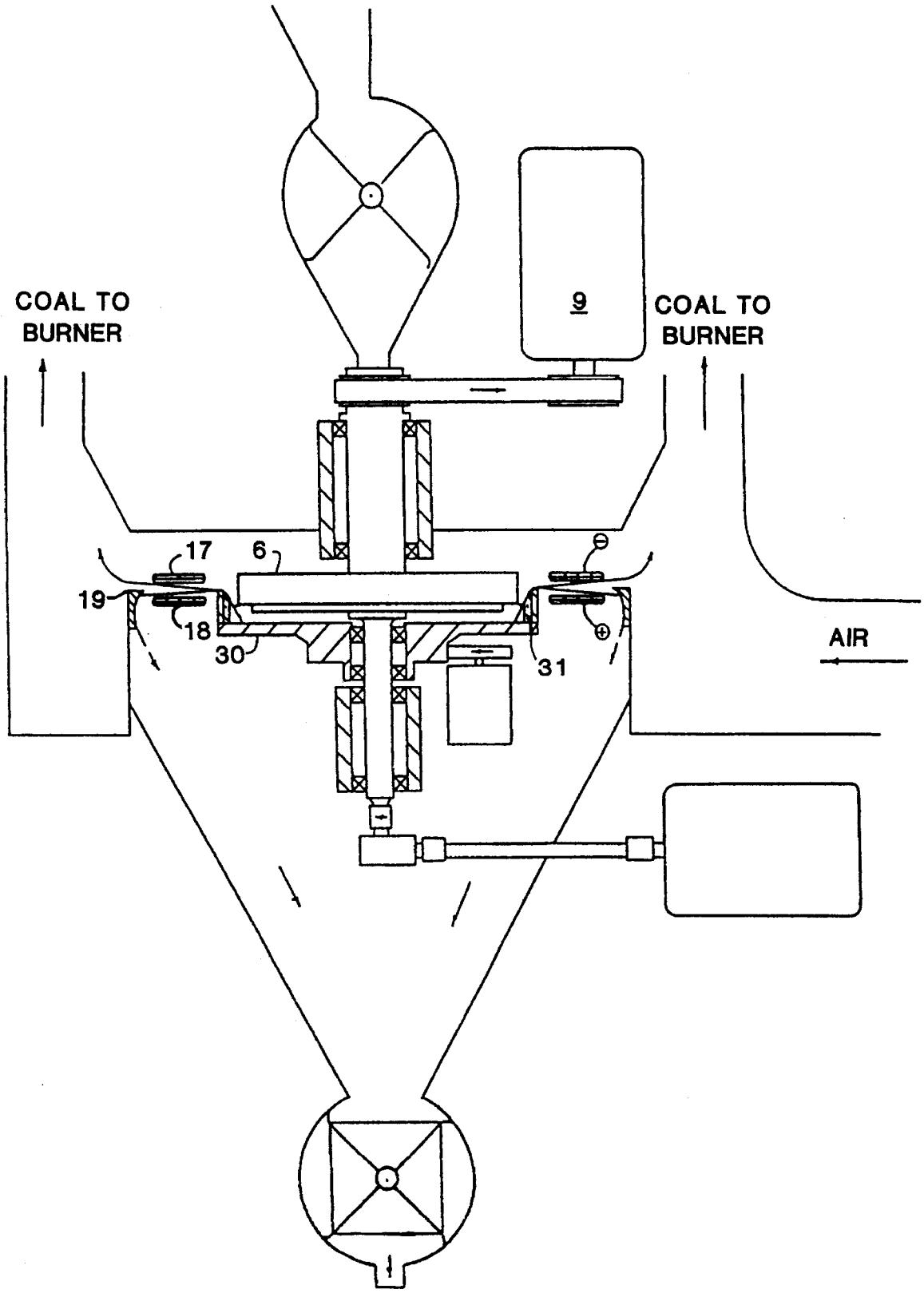
FIG. 2 is a sectional elevation through an electrostatic model incorporating features of this invention.
Figure 3:
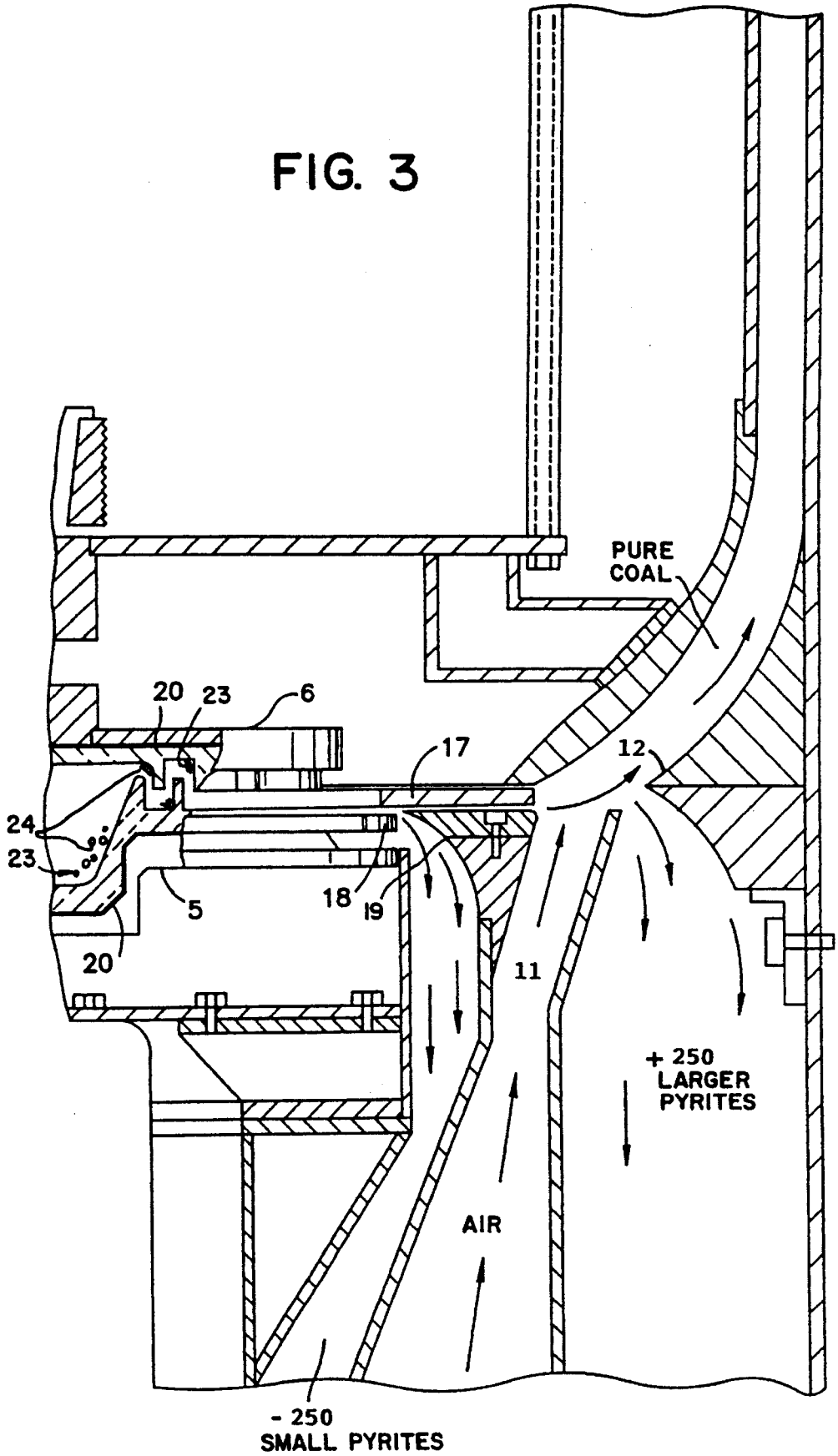
FIG. 3 is an enlarged view of a ring scoop placed to remove very small negatively charged pyritic particles after being deflected down into the path of the ring scoop.

Referring now to FIGS. 1 to 3 of the drawings, there is shown the preferred embodiments of a coal pulverizer purifier classifier. In operational use, the coal feedstock passes through an attrition mill where it is reduced, and across an electrostatic charge differentiator where a high percentage of impurities are rejected. The feedstock is then passed over an aerodynamic density differentiator 11 where impurities characterized by greater density than coal and greater size than −250 mesh are removed. The feedstock is then finally passed through a size classifier section 13 where the coal is passed along to a combustor if it is sufficiently small, or mixed in with incoming feed stock to be recirculated in the attrition mill for further reduction if it is too big. In one embodiment of the invention, a triboelectrostatic charge differentiator acts to reject impurities on the order of 1/400 of an inch or less which would otherwise get mixed in with the pure coal, thereby producing a cleaner final coal product.

FIG. 1 illustrates a vertical section view of the total system using both electrostatic means and aerodynamic means in a complementary relationship to separate out the pyritic impurities from the coal, while FIG. 2 illustrates the triboelectrostatic means working alone. Either system takes the form of a basically symmetrical cylindrical structure, except for the fuel infeed conveyor, the air infeed duct and the impurities conveyor.

Raw coal is fed into the mill with coal stock infeed conveyor 1. It falls down over a spreader cone 2 and down through a feed pipe 3. The coal lands in a center cup 4 of rapidly spinning lower rotor 5. A counter rotating spinning upper rotor 6 carries a first upside down cup 7, which receives the coal flying tangentially off the center cup 4 and, in turn, flings it tangentially on over to the next cup on the lower rotor 5.

From the drawings, it can be seen that each rotor 5 and 6 is formed by attaching a series of concentric rings to a base plate to form a series of cup-type cavities hereinafter referred to as either cups or rings. These rings bank up with material 23 to form the conical working surfaces 24 where the impacting and abrading actions occur, as best shown in FIG. 3.

This action continues from the upper cup to a lower cup until the coal has passed over all the coal banked rings on both lower and upper rotors 5 and 6, shown in FIGS. 1, 2, 3 and 4. The size reduction action of the coal occurs as the high speed counter rotating rotors 5 and 6 throw the coal from ring to counter rotating ring, causing very destructive high speed head-on collisions between particles. Also, destructive abrasive action occurs as the particles skid to a stop relative to the conical working surface 24, shown best in FIG. 3, of each conical section formed by a coal-banked ring followed by acceleration back in the opposite direction.

It is easy to see that this is a very destructive process that readily reduces the particles in size. Slower speeds will pulverize softer materials but it takes higher speeds to reduce harder materials. The lower and upper rotating rotors 5 and 6 are driven each by its own upper drive motor 8 or lower drive motor 9. For easier control of the product qualities motors 8 and 9 are of the variable speed type.

Following the pulverization of the coal in the attrition mill comes the purification stage. It can be either an aerodynamic or triboelectric system working individually or in combination. The aerodynamic version is a density difference separator.

Coming out over the last ring of the attrition mill the spray pattern will be a flat thin spray of radially flying pulverized material travelling at approximately the same speed. The flatness of the spray is caused by the special radius lip design of the last rotor ring to engage the coal. Other means may be used to ensure a flat spray of material at uniform speeds.

In the present invention the counter rotating rings 5 and 7 of the coal pulverizer unit are positioned close together so that all of the particles will hit harder and more often, thereby breaking up both the pure coal and the harder bone coal into smaller resulting particles. This special dimensional relationship between the counter rotating rings of the coal pulverizer produces finer particles of both pure coal and pyritic impurities which are then separated by a triboelectrostatic separation process.

The triboelectrostatic separation process is based on the triboelectrostatic phenomenon. When coal and pyritic particles are broken apart from each other, the coal takes on a positive charge and the pyrites a negative charge. By passing the particles between an upper negatively charged ring 17 and a lower positively charged ring 18 that each surround the outer periphery of the counter rotating rotors, the coal can be deflected upwardly and the pyrites downwardly to pass under the splitter ring blade 19. This arrangement is shown in FIGS. 1, 2 and 3. In the embodiment illustrated in FIG. 1, contact rings 21 and brushes 22 carry the negative and positive charges to rings 17 and 18. The rings are electrically isolated with insulation 20, and rotate with the pulverizer.

It has been determined that electrostatic separation of pure coal from pyritic impurities is effective when the velocity of the radial spray of particles from the pulverizer is 200 feet/second or less for the particle sizes and densities considered here and for an electrical charge limited only by the breakdown voltage of air. In the embodiment illustrated in FIG. 2, as the material to be separated comes out over the pulverizer it comes into contact with an independently mounted and separately driven outermost ring 30. The outermost ring 30 must be independently mounted and driven by a separate motor because it must run at a slower speed than the rotors of the pulverizer. This outermost ring 30 runs at a speed which will slow the velocity of the pulverized material so that it will exit the outermost ring 30 at a velocity of about 200 feet/second. Furthermore, this outermost ring 30 may be lined with a hard copper alloy 31. Rubbing contact with the copper tends to increase the electrostatic charges on the coal and the mineral impurities, thereby improving separation.

Also, in the embodiment shown in FIG. 2, the rings 17 and 18 surround the rotors 5 and 7 of the pulverizer, but are not attached to them. Electrostatically charged rings 17 and 18 are fixed in place.

The governing principle here is that opposite charges attract, while like charges repel. Hence, since the positive coal particles are both attracted to the upper negatively charged ring 17 and repelled away from the lower positively charged ring 18, they consequently do not get engulfed in the splitter ring blade 19 but pass on to the exiting coal stream in the embodiment shown in FIG. 3, or on to the aerodynamic separator in the embodiment shown in FIGS. 1 and 3. Conversely, the negatively charged pyritic impurities are attracted to the lower positively charged ring 18 and repelled away from the upper negatively charged ring 17, thereby becoming trapped by the splitter ring blade 19 and rejected.

Electrostatic separation can be effective in separating very small particles. It can be effective in deflecting pyritic materials in the range of 1/400 of an inch or smaller (or −250 mesh range). The −250 mesh pyritic material is removed by the splitter ring blade 19 shown in FIGS. 1, 2 and 3, that concentrically encircles the lower rotor and is placed in the plane of the material exiting the electrostatic rings 17 and 18 at an elevation just high enough that will cause it to shear through and scoop off the −250 mesh pyritic material that has been deflected downward by the electrostatically charged ring plates 17 and 18. (The −250 mesh size reference is illustrative only.)

In the embodiment illustrated in FIG. 1, as the material passes over the splitter blade 19, a high velocity air stream, rushing up from below through a concentrically located ring nozzle 11, shown in FIG. 1, passes vertically through this thin spray of material and will act with equal force per unit of cross sectional area on all particles flying through it.

The concentrically shaped and mounted separation splitter blade or ring 12, shown in FIG. 1, is set at an elevation high enough above the base trajectory so that bone coal particles of high specific gravity or density will pass under it because they will not accelerate in the upward direction as quickly as the low density coal particles. Size is relatively unimportant at this point, but relative density is significant. In U.S. Pat. No. 5,275,631, incorporated herein by reference, the effect of the air on the coal and pyritic particles is explained. Essentially, the purification of the less dense coal from the higher density pyritic impurities works well when the particle size of the impurities is greater than 1/400 of an inch.

Figure 4:
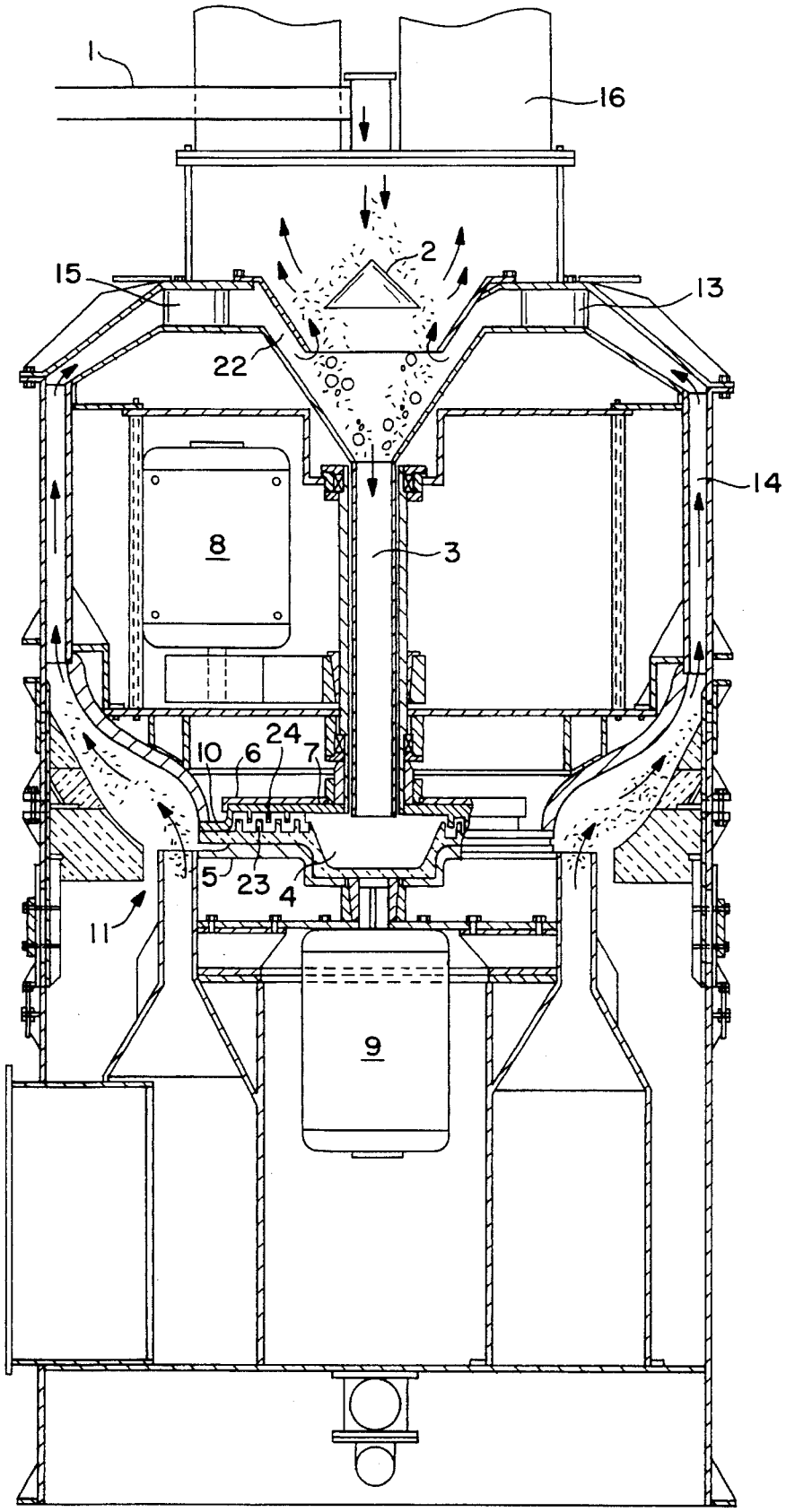
FIG. 4 is a sectional elevation of a model incorporating the pulverizer and classifier features of the invention.

Next in the overall process sequence is the coal size classifier 13, shown in FIGS. 1 and 4. The size classifier 13 can be used in combination with the pulverizer and separator, or it can be used alone with the pulverizer. In the embodiment shown in FIG. 4, as the pulverized material leaves the last ring of the rotor system, a high velocity air stream rushing up from below through a concentrically located ring nozzle 32 vertically transports to and through the size classifier unit 13 where the oversize particles are rejected downwardly into the stream of raw coal for regrinding.

The size classifier 13 works on the difference in centrifugal force developed by different weight bodies that are different in weight by virtue of being larger or smaller in size, not by difference in density. The density difference factor has been discussed in U.S. Pat. No. 5,275,631 as described in the purification process. By the time the coal reaches the differential size classifier section 13, the basic difference to be accounted for is size.

Size separation is accomplished by quickly changing the direction of the coal-particle bearing air stream duct 14 by directing it through size classifier vane openings 15, shown best in FIG. 4, past spreader cone 2 and on up fuel size coal air stream duct 16 on its way to a combustor. The centrifugal force imparted to the oversize particles in the air stream making the 180 degree (plus or minus) change in direction is so great that they do not make the turn and are caught up in the incoming stream of coal and are carried back through the attrition mill for further reduction as earlier mentioned.

The size classifier 13 with various arrangements of vane openings 15, can be constructed in various ways. It must be a properly functioning size classifier that effectively performs in conjunction with the aforesaid coal pulverizer-classifier system or the overall coal pulverizer-separator-classifier system.

Obviously many modifications and variations of the present invention are possible in light of the above teachings. It is, therefore, to be understood that the invention is meant to embrace all variations of the previously described structure as well as all equivalent apparatus that fall within the scope of the appended claims.

What is claimed is:

1. A fuel coal processing system, comprising:

a centrifugal coal pulverizer means in the form of a rotor system; and an electrostatic coal purifier means;

wherein said centrifugal type coal pulverizer means and said electrostatic coal purifier means are combined into one integral fuel coal preparation device.

2. A fuel coal processing system as recited in claim 1, wherein:

said coal pulverizer means consists of a pair of opposed multi-cup concentric ring rotors and an axially located feed tube;

said rotors counter rotating at a relatively high speed and concentrically mounted sufficiently close on a common axis to ensure thorough pulverizing;

whereby when coarse material is fed into the center of the rotor system through said axially located feed tube and said material is centrifugally thrown tangentially, progressively and outwardly from cup to cup on each of said counter rotating rotors, said material is reduced in size by the repeated high speed impacts and skidding abrasion associated with the process.

3. A fuel coal processing system as recited in claim 1, wherein, said pulverizer means consists of a pair of opposed multiconcentric ring rotors counter rotating at a relatively high speed and mounted sufficiently close on a common axis to ensure thorough pulverizing of all particles, with an axially located feed tube.

4. A fuel coal processing system as recited in claim 1, wherein, said pulverizer means consists of a pair of opposed multiconcentric ring rotors counter rotating at a relatively high speed and mounted sufficiently close on a common axis to ensure thorough pulverizing of all particles, with an axially located feed tube and means to ensure that the spray of said pulverized material leaves said rotor system in a flat, radiating, sheet spray pattern at essentially uniform speeds.

5. A fuel coal processing system as recited in claim 4, wherein said means to ensure that the spray of said pulverized material leaves said rotor system in a flat, radiating, sheet spray pattern is an independently mounted and rotating outer rotor for slowing the speed of the pulverized material as it exits said outer rotor.

6. A fuel coal processing system as recited in claim 1, wherein said electrostatic coal purifier means consists of an electrostatically charged ring assembly.

7. A fuel coal processing system as recited in claim 6, wherein said electrostatically charged ring assembly has a pair of rings that are dielectrically supported and carry charges of opposite polarity, a lower charged ring being positive and an upper charged ring being negative thereby attracting and repelling upwardly positively charged pure coal material and downwardly negatively charged pyritic material as the pulverized material leaves said electrostatically charged ring assembly to pass over a concentrically mounted scoop ring that is adjacent to said lower electrostatically charged ring and scoops off the lower strata of negatively charged pyritic material to be rejected from said process as the remaining product passes onto a combustor.

8. A fuel coal processing system as recited in claim 7, wherein a flat radiating sheet spray pattern of centrifugally flying pulverized coal leaving said rotor system traverses between said rotor system and said electrostatically charged ring assembly.

9. A fuel coal processing system as recited in claim 1, further comprising a fuel size classifier means.

10. A fuel coal processing system as recited in claim 9, wherein a pure coal portion is passed through said fuel size classifier means which separates out oversized coal and sends it back through for further reduction while allowing sufficiently reduced coal to be passed through to a combustor.

11. A fuel coal processing system, comprising:

a centrifugal pulverizer means having a pair of opposed multi-cup concentric ring rotors which rotate at a relatively high speed and are mounted sufficiently close on a common axis to ensure thorough pulverizing, an axially located feed tube and an independently mounted and rotating outer rotor for reducing the velocity of pulverized material, whereby when coarse material is fed into the center of the rotor system through said axially located feed tube and said material is centrifugally thrown tangentially, progressively and outwardly from cup to cup on each of said counter rotating rotors, said material is reduced in size by the repeated high speed impacts and skidding abrasion associated with the process;

an electrostatically charged ring assembly having a pair of rings carrying charges of opposite polarity, a lower charged ring being positive and an upper charged ring being negative thereby attracting and repelling upwardly positively charged material and downwardly negatively charged material; and a concentrically mounted scoop ring adjacent to said lower charged ring to scoop off the lower strata of negatively charged material which is rejected from said process as the remaining product passes onto a combustor.

12. A fuel coal processing system, as recited in claim 11, further comprising a fuel size classifier means for separating out oversized coal and sending it back for further reduction while allowing sufficiently reduced coal to pass through to said combustor.

13. A fuel coal processing system, comprising:

a centrifugal coal pulverizer means; and a fuel coal size classifier means;

wherein said centrifugal type coal pulverizer means and said fuel coal size classifier means are combined into one integral, cooperatively acting, fuel coal preparation device.

14. A fuel coal processing system as recited in claim 13, wherein said pulverizer means consists of a pair of multiconcentric ring rotors, mounted on a common axis and sufficiently close to ensure thorough pulverizing, counter rotating at a relatively high speed, with an axially located feed tube.

15. A fuel coal processing system as recited in claim 14, further comprising, an annular ring nozzle concentrically adjacent to said rotors for aerodynamically transporting pulverized material to and through said fuel coal size classifier means; and an annular concentric air passage through which said pulverized material is transported to said fuel size classifier means.

16. A fuel coal processing system as set forth in claim 14, wherein said rotors are each driven by an independent variable speed motor for varying the rotor speed thereby maximizing the pulverization and purification and of the coal being processed into fuel.

* * * * *